United States Patent [19]

Hallings et al.

[11] Patent Number: 4,928,211

[45] Date of Patent: May 22, 1990

[54] LIGHTHEAD ASSEMBLY

[75] Inventors: Leonard L. Hallings; Donald W. Bramer; Bruce A. Sanborn, all of Rochester; James E. Schryver, Wayland, all of N.Y.

[73] Assignee: MDT Corporation, Torrance, Calif.

[21] Appl. No.: 319,046

[22] Filed: Mar. 6, 1989

[51] Int. Cl.[5] ..... F21V 13/00

[52] U.S. Cl. ..... 362/33; 362/271; 362/428; 362/804

[58] Field of Search ..... 362/33, 233, 271, 273, 362/285, 289, 428, 804

[56] References Cited

U.S. PATENT DOCUMENTS

| | | | |
|---|---|---|---|
| 1,909,947 | 5/1933 | Greppin | 362/275 |
| 3,005,087 | 10/1961 | Klein | 362/33 |
| 3,887,801 | 6/1975 | Ilzig et al. | 362/33 |
| 4,025,778 | 5/1977 | Hayakawa | 362/233 |
| 4,316,237 | 2/1982 | Yamada et al. | 362/33 |

*Primary Examiner*—Stephen F. Husar

*Attorney, Agent, or Firm*—Trask, Britt & Rossa

[57] ABSTRACT

A multi-beam surgical lighthead includes a central pod and multiple peripheral pods mounted on pivots and mechanically linked to provide synchronized adjustment of the convergence portion of the peripheral lighthead upon the axial beam of the central pod. This mechanical linkage is operated by handles mounted both axially and transverse the lighthead.

23 Claims, 4 Drawing Sheets

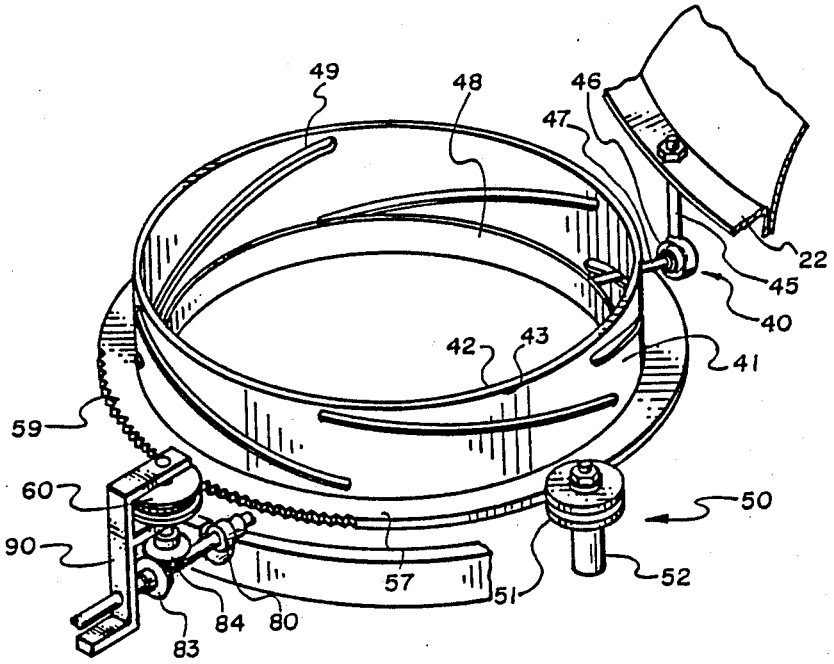
Fig. 3
Fig. 6
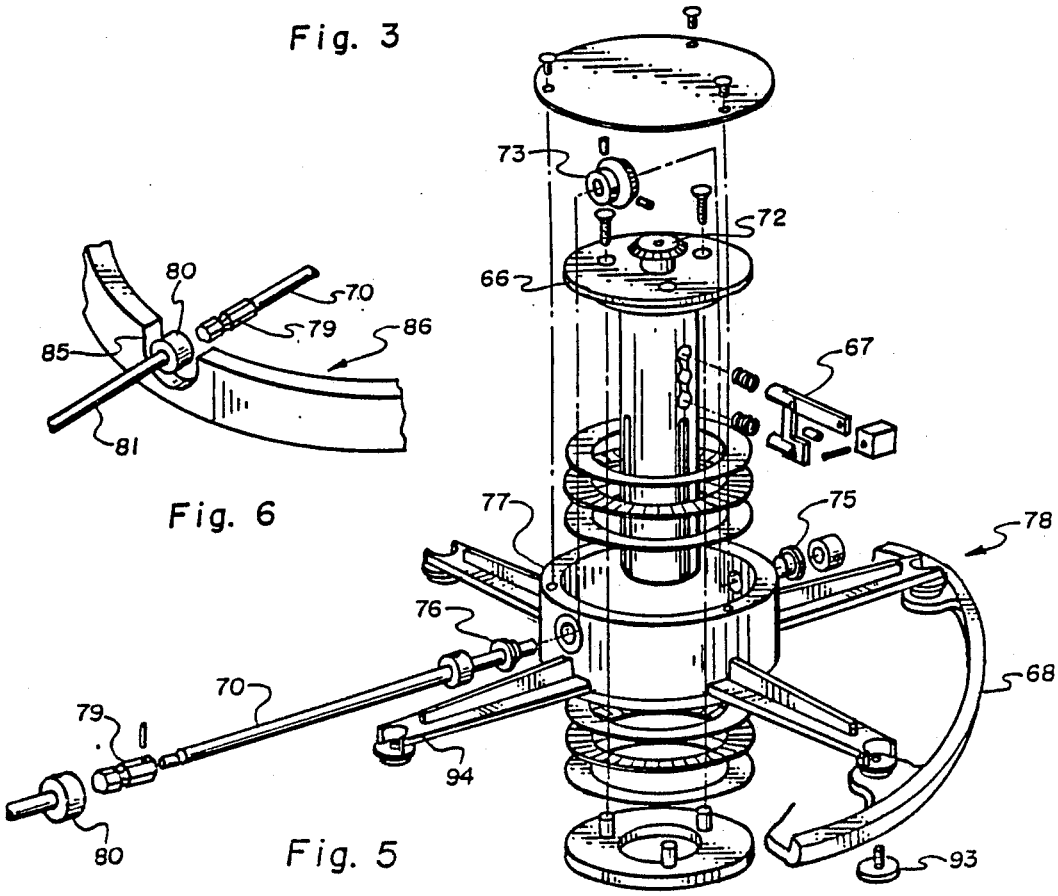
Fig. 5

LIGHTHEAD ASSEMBLY

BACKGROUND OF THE INVENTION

1. Field

This invention relates to lightheads containing multiple individual spotlights. It is specifically directed to means for adjusting the direction of light beams emanating from such individual spotlights, and provides an improved mechanism for synchronizing the movement of the individual spotlights from one or more remote locations.

2. State of the Art

Lighthead assemblies with multiple individual spotlights have long been used to provide a substantially shadowless illumination of a work area. A classic application of such assemblies is for the illumination of surgical operating sites. Lighthead assemblies with multiple spotlights evolved as an improvement over earlier operating room lighting fixtures which included expedients to scatter or diffuse the light from a single source. U.S. Pat. No. 1,909,947 illustrates an early arrangement of two spotlights with synchronized adjustment means. According to that arrangement, rotation of a central handle moves linkage structure which tilts the individual spotlights to change the direction of the light beams emanating therefrom. The light beams are thus caused to intersect (converge) at a selected distance from the spotlights. In this fashion, the shadow cast upon the illuminated area is reduced as compared to the shadow inherent with single source illumination. U.S. Pat. No. 3,055,087 discloses a more refined multi-beam lighthead assembly which provides synchronous orientation of a plurality of light beams by means of a cylindrical ring coupled by cam slots to individual spotlights arranged around the perimeter of the ring. U.S. Pat. No. 3,887,801 discloses another multi-beam lighthead assembly with a synchronized focusing mechanism. In this arrangement, a central cam ring is rotated by a handle axially disposed with respect to the assembly. The disclosures of U.S. Pat. Nos. 3,005,087 and 3,887,801 are incorporated by reference as portions of this disclosure for their detailed discussions of surgical lights with adjustable multi-beam lighthead assemblies, the objectives of such assemblies, and the mechanical linkages heretofore relied upon to effect synchronous linear shifting of the light beams emanating from multiple spotlights within the lighthead.

The various lighthead assemblies in current use have certain limitations and disadvantages. In a surgical setting, it is important for scrubbed personnel who are actually involved in a surgical procedure to be able to adjust (focus) the illumination resulting from the intersecting individual light beams. For this purpose, a centrally disposed handle, usually oriented parallel the central axis of the lighthead, is optimal. Such a handle must be capable of sterilization, and cannot be permitted to become contaminated during a procedure without imposing the concurrent constraint on scrubbed personnel of avoiding further handle contact. In many instances, however, it is either necessary or convenient for non-scrubbed personnel to focus the illumination while the surgical procedure is in progress. Such personnel cannot be permitted to contact a focusing handle which is required to remain uncontaminated. Currently available lighthead assemblies are not sufficiently adaptable to accommodate to these conflicting demands.

The synchronized focusing arrangements suggested to date have been structured with individual spotlights arranged in a circle, dedicating the region circumscribed by the lights to mechanical components. This arrangement limits the illumination obtainable at the center of an illuminated site and also limits the gradation of illumination obtainable from the center to the peripheral areas of the illuminated site.

SUMMARY OF THE INVENTION

The multiple beam lighthead assembly of this invention includes a lighthead and associated handle structure external said lighthead. The handle structure is linked to individual spotlights housed within the lighthead, and constitutes means for focusing illumination produced by the lighthead.

The lighthead includes a plurality of structurally similar pods, each of which includes a lamp, and may also include associated lenses, filters, reflectors and/or associated mechanical and/or electronic components. In any event, each pod may be regarded as including a spotlight which produces a light beam when the lighthead is energized.

Significantly, the lighthead includes a central pod constructed and arranged to produce an approximately axial light beam with respect to the lighthead. Ordinarily, the lighthead will deliver light through an approximately planar platform surface of a faceplate disposed between the pods and at least a portion of the handle structure. For purposes of this disclosure, a light beam emanating from the central pod in a direction approximately normal that planar surface is regarded as "axial."

A multiplicity of peripheral pods are mounted symmetrically around the central pod on pivot mounts. The peripheral pods are constructed and arranged to produce light beams, when the lighthead is energized, in a symmetrical pattern with respect to the axial beam of the center pod. In most instances, the peripheral pods are arranged to produce light beams forming a circle whose center is intersected by the axial light beam. The pivot mounts permit displacement of the pods (or at least the portion of the pods including the lamps) within a range of movement. By displacing the peripheral pods a selected amount, the light beams emanating therefrom are caused to intersect (converge with) the axial light beam at a corresponding resultant location (the illuminated area). Movement of the intersection point (region of convergence) along the axial light beam is regarded as "focusing" within the context of this disclosure.

Coordination means disposed within the lighthead provide synchronized movement of the peripheral pods. Each pod is thus displaced an equivalent amount to assure that all peripheral light beams simultaneously intersect at the same location along the axial light beam throughout the entire range of movement permitted by the respective pivot mounts. The coordinating means may take various forms. As currently preferred, it includes a rotatable cylindrical surface element and reaction means operably associated with each peripheral pod and the cylindrical surface element. The surface element constitutes or otherwise carries a camming surface means (slots, grooves, ramps, bosses, etc.) and is mounted to rotate on an axis approximately parallel (typically congruent) with said axial light beam. The reaction means pivots (displaces) the pods in a first direction in response to clockwise rotation of the cylindrical surface element and in a second direction opposite the first direction in response to counterclockwise rotation of that element. Although the cylindrical surface element may comprise a surface of an upstanding cylindrical tube disposed to circumscribe the central pod, the term "cylindrical," is intended in this disclosure to include any mechanically equivalent configuration which permits the presence of a central pod while providing for synchronous movement of the peripheral pods.

Also housed within the lighthead are all, or a major portion, of the mechanical components required to rotate the cylindrical surface element. These components constitute drive means and are mechanically coupled to the cylindrical surface element as well as to external handle structure. A significant feature of the preferred embodiments of this invention is the provision of separate handle structures for use by scrubbed personnel from a first location and unscrubbed personnel from a second location remote from the first location. The first, or sterile, handle is typically located near, often congruent with, the axial light beam. In practice, any shadow induced by this location of the handle is reilluminated by redistributed light from the central pod. The contribution of the central light beam is thus not materially impacted by the handle or associated mounting structure. The second, or non-sterile, handle is typically located at the perimeter of the lighthead for ready, non-interfering access. Ideally, at least the first handle is removable and either sterilizable or disposable.

Each pod normally includes a cover lens. The first, axial, handle may connect to a drive post which protrudes through the cover lens of the central pod. This post may releasably couple through a detachable drive assembly to the coordination means, thereby permitting access to the central pod for cleaning or lamp replacement.

BRIEF DESCRIPTION OF THE DRAWINGS

In the drawings which illustrate what is currently regarded as the best mode for carrying out the invention:

FIG. 3 is a perspective view illustrating a portion of the mechanism shown in FIG. 2 in assembled condition;

FIG. 5 is an enlarged exploded view of a removable drive mechanism illustrated in FIG. 2; and FIG. 6 is an enlarged fragmentary perspective view of a portion of the structure illustrated by FIG. 3.

DESCRIPTION OF THE ILLUSTRATED EMBODIMENT

Figure 1:
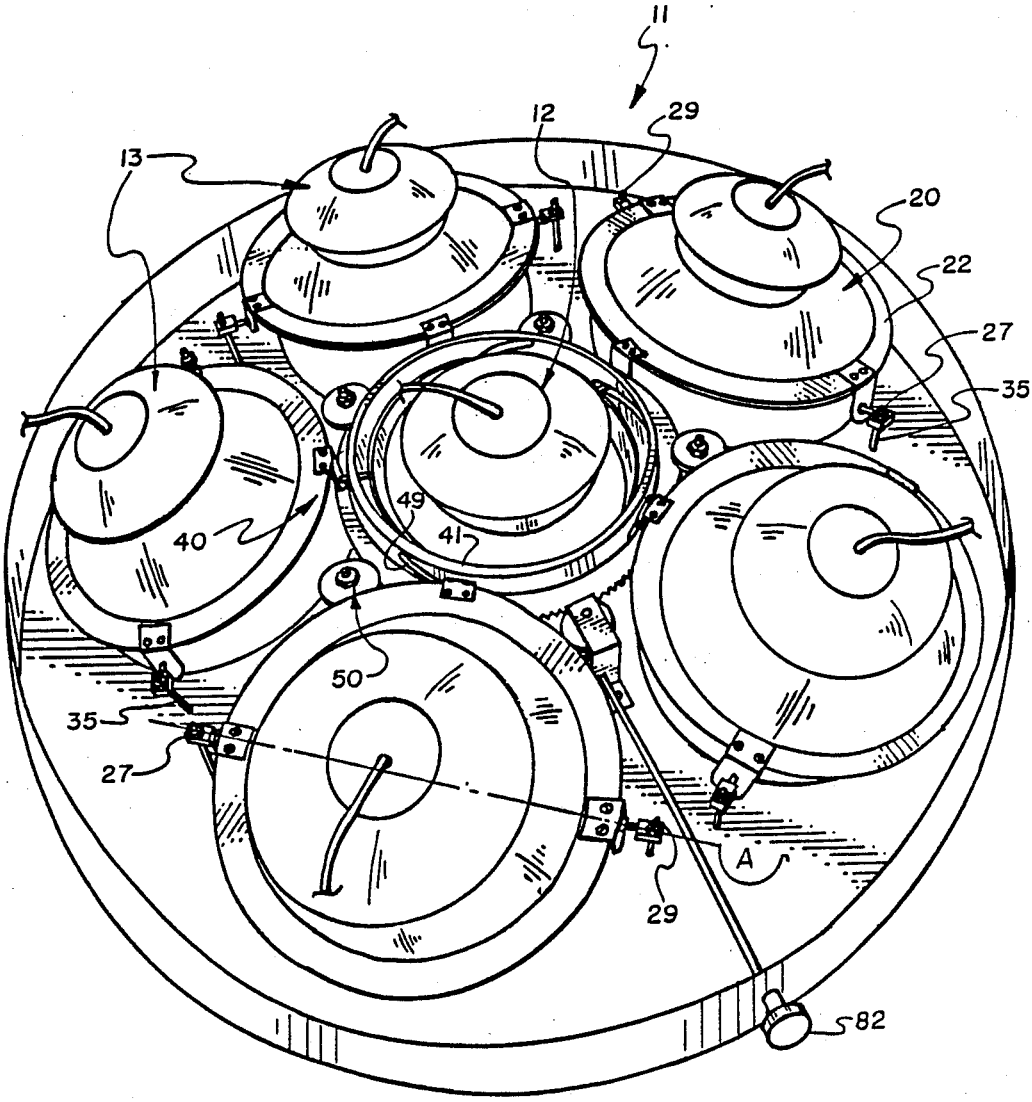
FIG. 1 is a partial perspective view from the top of a lighthead embodying the invention with a portion of the housing removed to display internal components.
Figure 2:
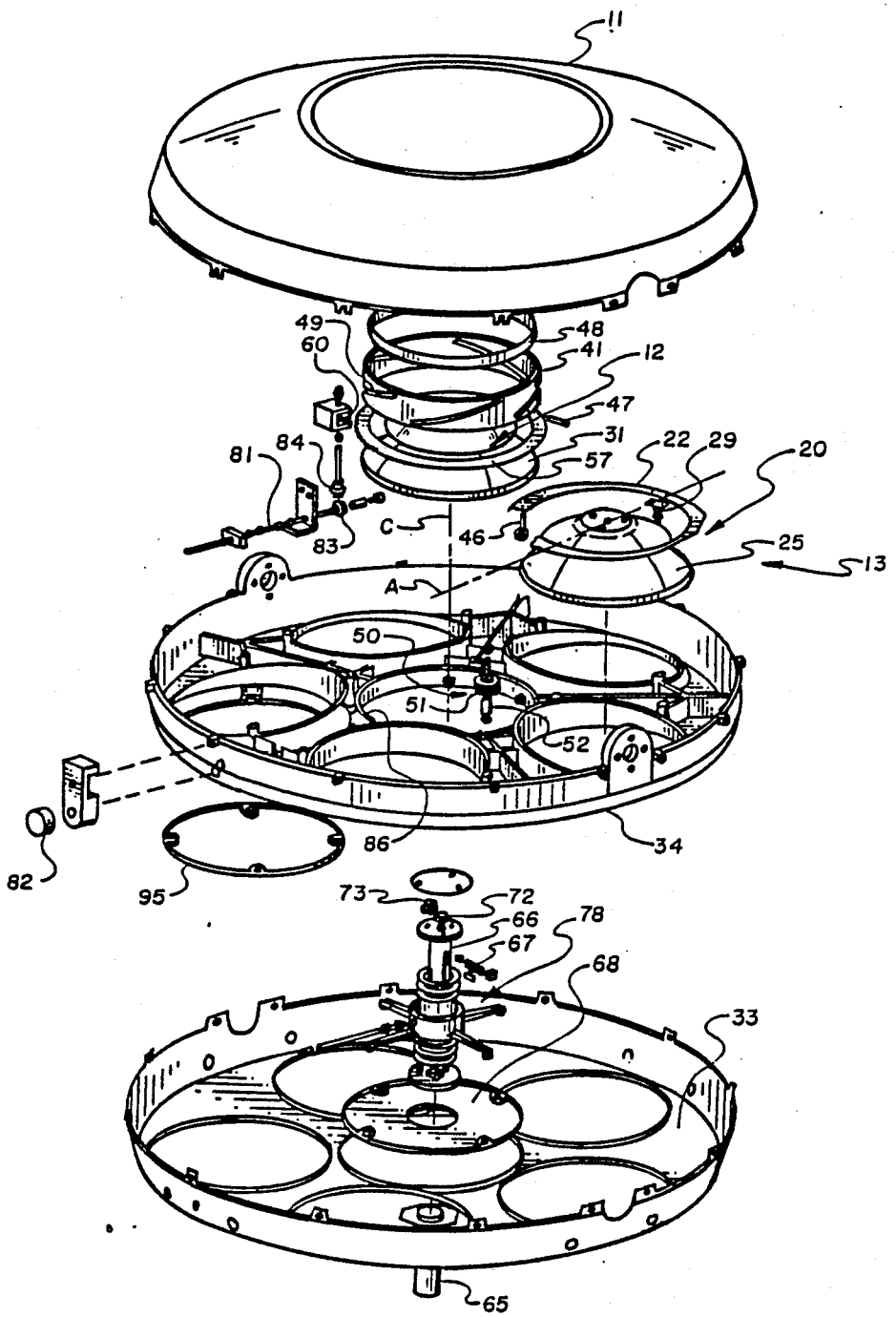
FIG. 2 is an exploded view of a preferred embodiment of the invention.

The drawings illustrate a lighthead assembly, designated generally 11, with a central pod, designated generally 12 and five symmetrically arranged, substantially identical peripheral pods, each designated generally 13.

Each of the pods 12, 13 includes a spotlight assembly 20. The assemblies 20 of the peripheral pods 13 each include a circumferential support ring 22, which may be integral with, but is illustrated as a separate mounting element for, the reflector 25. The support rings 22 are supported at diametrically opposed circumferential locations by pivot mountings 27, 29. The pivot mountings 27, 29 are located to permit tilting of the mounting rings 22, and thus the reflectors 25, on an axis A which is transverse and non-intersecting with the central axis C of the central pod 12. As illustrated, the pivot mountings 27, 29 of all of the peripheral pods 13 define a circle which is concentric with respect to the stationary reflector 31 of the central pod 12. A typical arrangement of the type illustrated permits aiming the light beam emanating from a peripheral pod 13 so that it intersects the axial light beam emanating from the central pod 12 at selected locations ranging from about 2½ to about 6 feet distant from the faceplate 33 of the lighthead 11. The pivot mountings 27, 29 are supported from the platform 34 on studs 35 which may be adjustable, e.g. by threads (not shown), to constitute adjustment means.

A separate mechanical linkage, designated generally 40, couples each support ring 22 with a cam ring 41. The cam ring 41 may take the form of a cylindrical annulus, as shown, defined by inner and outer cylindrical walls 42, 43. As illustrated, a threaded stud 45 extends down from the support ring 22, terminating in a ball joint connection 46 with a pin 47 carried by a cam ring follower ring 48. The ring 48 is dimensioned to reciprocate within the cam ring 41. The ball joint connector 46 illustrated constitutes a presently preferred self-aligning bearing. Individual pins 47 are cantilevered from the ring 48 through corresponding inclined cam slots 49 provided through the wall of the cam ring 41. As the ring 41 is rotated clockwise or counterclockwise, the pins 47 are urged either up or down, respectively, thereby tilting in linear synchronized coordination the peripheral pods 13 on their respective pivot mounts 27, 29.

The cam ring 41 is mounted to encircle the center pod 12. It is supported by an idler wheel arrangement including spaced idler wheel assemblies, designated generally 50, including grooved cylindrical support wheels 51 mounted to rotate on axles 52 anchored to the platform 34. The grooved wheels 51 engage the rim of a drive ring 57 which supports the cam ring 41. A portion 59 of the drive ring is provided with gear teeth adapted to mesh with the corresponding teeth of a drive spur gear 60. The spur gear 60 constitutes a portion of a drive mechanism best illustrated by FIG. 4. Although the mechanism illustrated is regarded as practical and reliable, various gear systems, friction drives, belt drives, chain drives and their respective equivalents can be substituted for the assembly shown. The invention contemplates the use of any drive means which can be adapted satisfactorily to mechanically couple with and serve to rotate the cam ring 41 by means of a remote handle mechanism.

Figure 4:
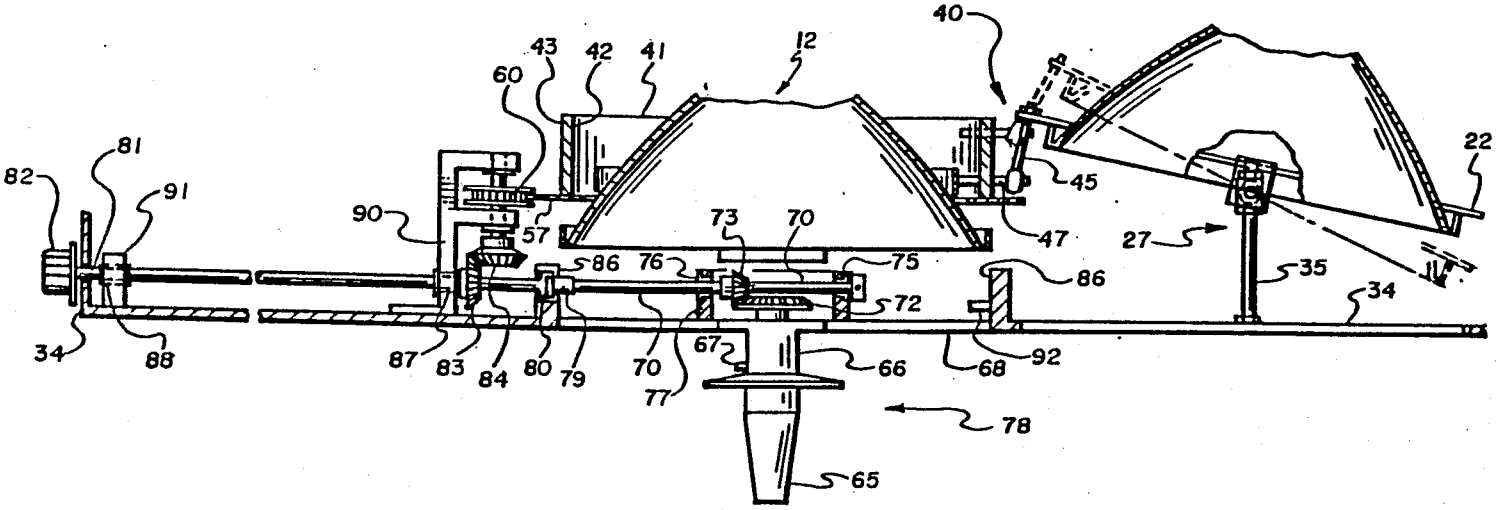
FIG. 4 is a fragmentary cross-sectional view illustrating a typical coordination mechanism of this invention and associated drive components.

Referring to FIG. 4, a first, sterilizable handle 65 is detachably connected to a first shaft, (the drive post 66) by means of a spring-actuated coupling mechanism, designated generally 67. The handle 65, post 66 and mechanism 67 illustrated are disclosed in more detail in co-pending U.S. patent application Ser. No. 07/319,048, filed Mar. 6, 1989, now U.S. Pat. No. 4,878,156. The post 66 is mounted to protrude through a cover lens element 68 of the central pod 12 and is coupled to a drive shaft 70 through matched bevel gears 72, 73. The shaft 70 is journaled through bearings 75, 76 in structural ring 77 of a central focus drive module, designated generally 78 (see FIG. 5). Shaft 70 terminates in a male spline 79 which mates with a female spline 80. Shaft segment 81 extends from the lighthead platform 34 and attaches to a second handle (the knob 82). Rotation of the shaft 70 in either direction by either of the handles 65, 82, causes a corresponding rotation of matched bevel gears 83, 84 and thus the spur gear 60, thereby turning the cam ring 41.

The shaft 81 extends through a notch 85 in the upstanding wall 86 (see FIG. 6), and is journaled through bearings 87, 88 in supports 90, 91. The central lens 68 and central focus module 78 are attached to bosses 92 extending from the wall 86 by screws 93 (see FIG. 5). The focus module 78 and handle 65 are thus located in an inherently non-illuminated zone, except for the structural supports 94. The shadow induced by the supports 94 is negligible.

Relamping and cleaning of the central pod 12 is easily accomplished by removing the cover lens 68 with the central focus module 78 attached. Relamping and cleaning of the peripheral pods 13 requires removal of cover lenses 95 in conventional fashion.

Reference herein to details of the illustrated embodiments is not intended to limit the scope of the appended claims which themselves recite those features regarded as important to the invention. It will be apparent to those skilled in the art that the benefits of the disclosed invention can be obtained by the substitution of various mechanical expedients equivalent to those specifically disclosed and illustrated. Moreover, the drawings illustrate a number of components which, while not referred to specifically in the specification, should be instructive to one of ordinary skill in the art.

What is claimed is:

1. A lighthead assembly, comprising a lighthead with:

a central pod, including a lamp, said central pod being mounted within said lighthead and constructed and arranged such that when said lighthead is energized, said pod produces an axial light beam with respect to said lighthead;

a multiplicity of peripheral pods, each including a lamp, said peripheral pods being mounted within said lighthead symmetrically around said central pod on pivot mounts, said peripheral pods being constructed and arranged so that when said lighthead is energized, said peripheral pods produce peripheral light beams originating symmetrically with respect to said axial light beam, said pivot mounts permitting displacement of said peripheral pods within a range of pivotal movement, whereby the peripheral light beams originating from said peripheral pods may be caused to intersect said axial light beam at selected locations corresponding to selected amounts of displacement within said range of movement;

coordination means operably associated with said peripheral pods, constructed and arranged to coordinate the pivotal movement of said peripheral pods so that all of said horizontal light beams simultaneously intersect said axial light beam at any said selected location throughout said range of movement;

said coordination means including a cylindrical surface rotatably mounted within said lighthead about an axis of rotation approximately parallel said axial light beam, said cylindrical surface element carrying camming surface means; and reaction means, operably associated with each of said peripheral pods and said camming surface means to effect synchronized pivoting of said peripheral pods in a first direction as said cylindrical surface element is rotated clockwise and in a second direction, opposite said first direction, as said cylindrical surface element is rotated counterclockwise;

drive means, mechanically coupled to, and constituting means for rotating, said cylindrical surface element; and handle structure external said lighthead, mechanically coupled to said drive means and constituting means for actuating said drive means.

2. A lighthead assembly according to claim 1 wherein said handle structure is associated with a central focus module mounted axially with respect to said center pod, said module including mechanical components linking said handle with said drive means.

3. A lighthead assembly according to claim 1, wherein said peripheral pods comprise individual pivotally mounted spotlights and said coordination means comprises synchronous means for pivoting said spotlights to cause light beams emanating from said spotlights to converge at various locations along a central axis, said synchronous means including:

synchronizing structure mechanically linked to said spotlights and operable by rotation of a drive shaft;

first handle means at a first location external said lighthead operably coupled to said drive shaft; and second handle means at a second location external said lighthead remote from said first location operably coupled to said drive shaft.

4. An improvement according to claim 3 wherein said first handle means is associated with a central focus module mounted axially with respect to said lighthead assembly, said module including mechanical components linking said handle means with said synchronous means.

5. An improvement according to claim 4 wherein said module is removably mounted and cooperatively adapted to permit its removal without disturbing said second handle means or said drive shaft.

6. A lighthead assembly, comprising a lighthead with:

a central pod, including a lamp, said central pod being mounted within said lighthead and constructed and arranged such that when said lighthead is energized, said pod produces an axial light beam with respect to said lighthead;

a multiplicity of peripheral pods, each including a lamp, said peripheral pods being mounted within said lighthead symmetrically around said central pod on pivot mounts, said peripheral pods being constructed and arranged so that when said lighthead is energized, said peripheral pods produce peripheral light beams originating symmetrically with respect to said axial light beam, said pivot means permitting displacement of said peripheral pods within a range of pivotal movement, whereby the peripheral light beams originating from said peripheral pods may be caused to intersect said axial light beam at selected locations corresponding to selected amounts of displacement within said range of movement;

coordination means operably associated with said peripheral pods, constructed and arranged to coordinate the peripheral movement of said peripheral pods so that all of said peripheral light beams simultaneously intersect said axial light beam at any said selected location throughout said range of movement;

said coordination means including a cylindrical surface element rotatably mounted within said lighthead about an axis of rotation approximately parallel said axial light beam, said cylindrical surface element carrying inclined spiral surfaces constituting camming surface means; and reaction means, operably associated with each of said peripheral pods and said camming surface means to effect synchronized pivoting of said peripheral pods in a first direction as said cylindrical surface element is rotated clockwise and in a second direction, opposite said first direction, as said cylindrical surface element is rotated counterclockwise;

drive means, mechanically coupled to, and constituting means for rotating, said cylindrical surface element; and handle structure external said lighthead, mechanically coupled to said drive means and constituting means for actuating said drive means.

7. A lighthead assembly according to claim 6 wherein said reaction means includes a cam ring follower mounted to move longitudinally with respect to said axis of rotation in response to rotation of said inclined spiral surfaces, said cam ring follower carrying structure interactive with cooperative structure carried by said peripheral pods.

8. A lighthead assembly according to claim 6 wherein said cylindrical surface element comprises a cylindrical annulus defined by inner and outer cylindrical walls and said spiral surface comprise slots in said annulus.

9. A lighthead assembly according to claim 8 wherein the number of said slots corresponds to the number of said peripheral pods and each said slot operably cooperates with reaction means structure carried by a respective said peripheral pod.

10. A lighthead assembly according to claim 9 including a cam ring follower constituting a portion of said reaction means, said cam ring follower including a ring mounted within said inner cylindrical wall approximately concentric with said axis of rotation to move longitudinally with respect to said axis of rotation in response to rotation of said cylindrical surface element.

11. A lighthead assembly according to claim 10 including pin elements extending from attachment with said cam ring follower, said pins being mounted in operably cooperable arrangement with said structure carried by respective said peripheral pods.

12. A lighthead assembly according to claim 11 wherein each said peripheral pod carries a self-aligning bearing means mounted in engagement with a respective said pin element.

13. A lighthead assembly according to claim 6, wherein said peripheral pods comprise individual pivotally mounted spotlights and said coordination means comprises synchronous means for pivoting said spotlights to cause light beams emanating from said spotlights to converge at various locations along a central axis, said synchronous means including:

synchronizing structure mechanically linked to said spotlights and operable by rotation of a drive shaft;

first handle means at a first location external said lighthead operably coupled to said drive shaft; and second handle means at a second location external said lighthead remote from said first location operably coupled to said drive shaft.

14. A lighthead assembly, comprising a lighthead with:

a central pod, including a lamp, said central pod being mounted within said lighthead and constructed and arranged such that when said lighthead is energized, said pod produces an axial light beam with respect to said lighthead;

a multiplicity of peripheral pods, each including a lamp, said peripheral pods being mounted within said lighthead symmetrically around said central pod on pivotal mounts, said peripheral pods being constructed and arranged so that when said lighthead is energized, said peripheral pods produce peripheral light beams originating symmetrically with respect to said axial light beam, said pivot mounts permitting displacement of said peripheral pods within a range of pivotal movement, whereby the peripheral light beams originating from said peripheral pods may be caused to intersect said axial light beams at selected locations corresponding to selected amounts of displacement within said range of movement;

coordination means operably associated with said peripheral pods, constructed and arranged to coordinate the pivotal movement of said peripheral pods so that all of said peripheral light beams simultaneously intersect said axial light beam at any said selected location throughout said range of movement;

said coordination means including a cylindrical surface element rotatably mounted within said lighthead about an axis of rotation approximately parallel said axial light beam, said cylindrical surface element carrying camming surface means; and reaction means, operably associated with each of said peripheral pods and said camming surface means to effect synchronized pivoting of said peripheral pods in a first direction as said cylindrical surface element is rotated clockwise and in a second direction, opposite said first direction, as said cylindrical surface element is rotated counterclockwise;

drive means, mechanically coupled to, and constituting means for rotating, said cylindrical surface element, said drive means including a first shaft extending approximately parallel said axial light beam to turn on an axis which intersects said central pod, said first shaft being mechanically coupled to said cylindrical surface element; and handle structure external said lighthead, mechanically coupled to said drive means and constituting means for actuating said drive means.

15. A lighthead assembly according to claim 14 including a first handle releasably connected to said first shaft, external said lighthead.

16. A lighthead assembly according to claim 15 wherein said first shaft projects through a cover lens associated with said central pod.

17. A lighthead assembly according to claim 14 wherein said first shaft is coupled to said cylindrical surface element through a drive assembly.

18. A lighthead assembly according to claim 17 including a second shaft mechanically associated with said drive assembly, said second shaft being oriented transverse said first shaft and extending to attachment with a second handle external said lighthead.

19. A lighthead assembly according to claim 17 wherein said drive assembly is a gear drive assembly.

20. A lighthead assembly according to claim 19 including a second shaft mechanically associated with said gear drive assembly, said second shaft being oriented transverse said first shaft and extending to attachment with a second handle external said lighthead.

21. A lighthead assembly according to claim 14, wherein said peripheral pods comprise individual pivotally mounted spotlights and said coordination means comprises synchronous means for pivoting said spotlights to cause light beams emanating from said spotlights to converge at various locations along a central axis, said synchronous means including:

synchronizing structure mechanically linked to said spotlights and operable by rotation of a drive shaft;

first handle means at a first location external said lighthead operably coupled to said drive shaft; and second handle means at a second location external said lighthead remote from said first location operably coupled to said drive shaft.

22. A lighthead assembly, comprising a lighthead with:

a central pod, including a lamp, said central pod being mounted within said lighthead and constructed and arranged such that when said lighthead is energized, said pod produces an axial light beam with respect to said lighthead;

a multiplicity of peripheral pods, each including a lamp, said peripheral pods being mounted within said lighthead symmetrically around said central pod on pivot mounts, said peripheral pods being constructed and arranged so that when said lighthead is energized, said peripheral pods produce peripheral light beams originating symmetrically with respect to said axial light beam, said pivot mounts permitting displacement of said peripheral pods within a range of pivotal movement, whereby the peripheral light beams originating from said peripheral pods may be caused to intersect said axial light beam at selected locations corresponding to selected amounts of displacement within said range of movement;

coordination means operably associated with said peripheral pods, constructed and arranged to coordinate the pivotal movement of said peripheral pods so that all of said peripheral light beams simultaneously intersect said axial light beam at any said selected location throughout said range of movement;

said coordination means including a cylindrical surface element rotatably mounted within said lighthead about an axis of rotation approximately parallel said axial light beam, said cylindrical surface element carrying camming surface means; and reaction means, operably associated with each of said peripheral pods and said camming surface means to effect synchronized pivoting of said peripheral pods in a first direction as said cylindrical surface element is rotated clockwise and in a second direction, opposite said first direction, as said cylindrical surface element is rotated counterclockwise;

drive means, mechanically coupled to, and constituting means for rotating, said cylindrical surface element; and handle structure external said lighthead, mechanically coupled to said drive means and constituting means for actuating said drive means;

wherein said handle structure is associated with a central focus module mounted axially with respect to said central pod, said module including mechanical components linking said handle with said drive means, and being removably mounted and cooperatively adapted to said drive means to permit removal of said module without disturbing other components associated with said drive means.

23. A lighthead assembly according to claim 22, wherein said peripheral pods comprise individual pivotally mounted spotlights and said coordination means comprises synchronous means for pivoting said spotlights to cause light beams emanating from said spotlights to converge at various locations along a central axis, said synchronous means including:

synchronizing structure mechanically linked to said spotlights and operable by rotation of a drive shaft;

first handle means at a first location external said lighthead operably coupled to said drive shaft; and second handle means at a second location external said lighthead remote from said first location operably coupled to said drive shaft.

* * * * *